US005967949A

United States Patent [19]

Davenport

[11] Patent Number: 5,967,949

[45] Date of Patent: Oct. 19, 1999

[54] EXERCISE DEVICE

[76] Inventor: Michael D. Davenport, 34645 Crew Rd., Pomeroy, Ohio 45769

[21] Appl. No.: 09/100,102

[22] Filed: Jun. 19, 1998

Related U.S. Application Data

[60] Provisional application No. 60/050,724, Jun. 25, 1997, abandoned.

[51] Int. Cl.[6] ..... A63B 21/06; A63B 21/075

[52] U.S. Cl. ..... 482/93; 482/46; 482/99; 482/108; 482/109

[58] Field of Search ..... 482/44–46, 23, 482/94, 99, 102, 103, 106, 108, 109

[56] References Cited

U.S. PATENT DOCUMENTS

| | | | |
|---|---|---|---|
| 4,964,630 | 10/1990 | Curtiss . | |
| 5,312,309 | 5/1994 | Fox | 482/45 |
| 5,580,335 | 12/1996 | Smith, IV . | |
| 5,582,564 | 12/1996 | Nichols, Sr., et al. . | |

FOREIGN PATENT DOCUMENTS

| | | | |
|---|---|---|---|
| 738579 | 12/1932 | France | 482/94 |

*Primary Examiner*—John Mulcahy
*Attorney, Agent, or Firm*—Robert N. Blackman

[57] ABSTRACT

An exercise device is provided having (a) an axle unit convertible into a hammer type exercising device, (b) an adjustable stand (c) a resistance unit attached to the axle unit, and a detachable handle elements. The axle unit is rotatably and releasably attached to the adjustable stand for permitting rotation of the axle unit about a horizontal axis. The resistance unit is attached to the axle unit for biasing the axle unit in a given position. The handle elements are attached to the axle unit for permitting the user to forcibly counter the bias provided by the resistance unit to permit exercise of the upper body. The axle unit is removable from the resistance unit and the adjustable stand, and may be converted into dumb bell or to a hammer, and by utilization of the resistance unit may be converted to a wrist roller.

7 Claims, 2 Drawing Sheets

EXERCISE DEVICE

This application claims the benefit of U.S. Provisional Application 60/050,724 filed Jun. 25, 1997, now abandoned.

BACKGROUND OF THE INVENTION

1. Field of the Invention

The present invention relates to exercise devices, and more particularly relates to exercise devices for enhancing grip strength and upper body strength.

2. Background of the Invention

Prior exercise equipment has typically involved the ability to enhance one or more areas of strength in the body. Prior efforts to improve wrist strength have utilized such devices as the Thor's hammer, which in its basic form has typically involved a bar having a weight at one end thereof, and utilization thereof has typically involved grabbing the unweighted end and using a hammer motion to enhance the strength of the wrist. Such devices, however, have had limited utility for the strengthening of other portions of the body.

Consequently, there is a need for a hammer type exercising device which allows for adaptation for strengthening other parts of the body such as the upper body.

SUMMARY OF THE INVENTION

The present invention provides an exercise device having (a) an axle unit convertible into a hammer type exercising device, (b) an adjustable stand (c) a resistance unit attached to the axle unit, and detachable handle elements. The axle unit is rotatably and releasably attached to the adjustable stand for permitting rotation of the axle unit about a horizontal axis. The resistance unit is attached to the axle unit for biasing the axle unit in a given position. The handle elements are attached to the axle unit for permitting the user to forcibly counter the bias provided by the resistance unit to permit exercise of the upper body. The axle unit is removable from the resistance unit and from the adjustable stand, and may be converted into a dumb bell or into a hammer, and by utilization of the resistance unit may be converted to a wrist roller.

DETAILED DESCRIPTION OF THE INVENTION

Figure 5:
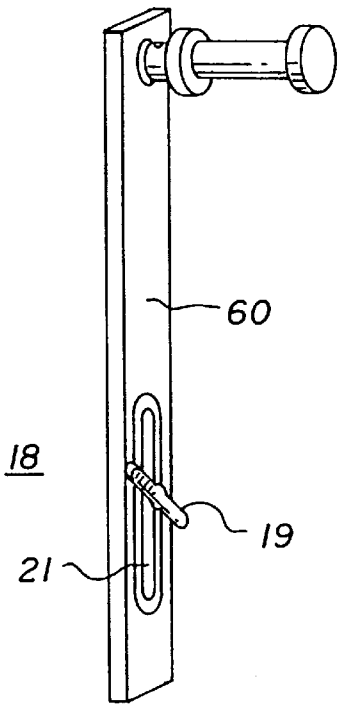
FIG. 5 is an alternative embodiment of a handle unit for the device.
Figure 1:
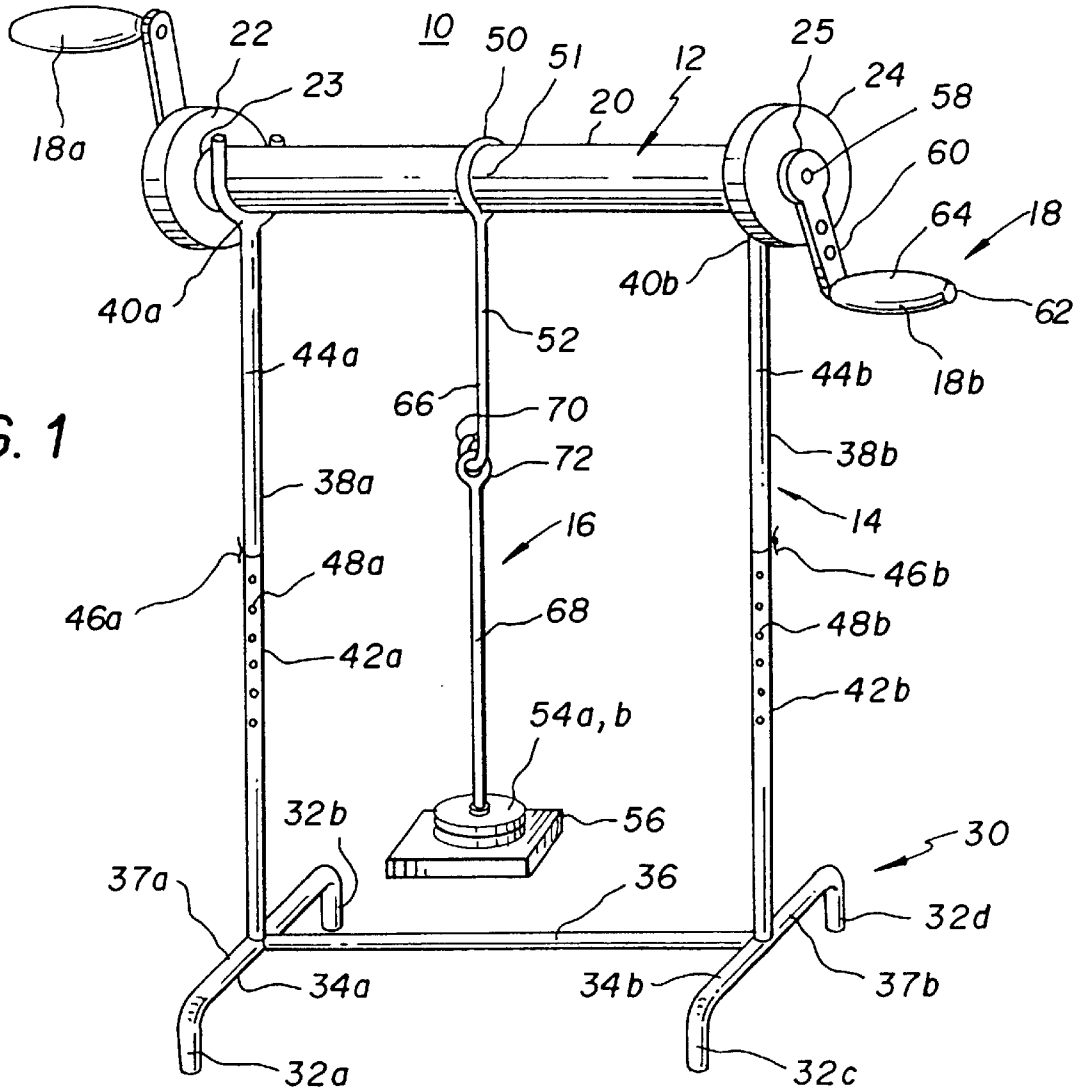
FIG. 1 is a prospective view of the exercise device of the present invention.

As best shown in FIG. 1, an exercise device (10) is provided comprising an axle unit (12) rotatively received and carried by an adjustable stand (14). A resistance unit (16) is attached to the axle unit (12) and depends therefrom for biasing the axle unit (12) in a particular orientation. Detachable handle units (18) are shown attached to the axle unit (12) for engagement by a user of the device (10). As shown in FIG. 5, an alternative embodiment of a handle unit (18) is shown having an adjustable length relative to the connection point with the axle unit (12) by having a tightening element (19) which attaches to the end of the axle unit (12) and which is selectively movable within a slot (21) which runs within the length of the handle (18). When in use, the user (exerciser) of the exercise device (10) grabs a first handle (18*a*) with the user's left hand and the second handle (18*b*) with the user's right hand and forces rotation of the axle unit (12) about a horizontal axis effectively working against the resistance unit (16) by storing potential energy therein and then following several rotations of the axle unit (12), the stored potential energy in the resistance unit (16) is allowed to release effectively working against the user. This motion effectively works the upper body of the user.

As shown in FIGS. 1, 2, 3 and 4, the axle unit (12) comprises an elongated cylindrical bar (20) which is substantially linear, and has attached to one end thereof a first (cylindrical, circular, annular, doughnut shaped) handle member (22) and attached at another end thereof has a second (cylindrical, circular, annular, doughnut shaped) handle member (24). Each end of the axle unit (12) has a threaded orifice for releasably receiving handle units (18*a, b*), specifically the first end (23) of the axle unit (12) has a first threaded orifice (26) and a second end (25) of the axle unit (12) has a second threaded orifice (28).

As shown in FIG. 1, the adjustable stand (14) has a base (30) which preferably comprises four legs (32*a, b, c, d*) wherein a first pairs of legs (32*a, b*) is connected together in a fixed fashion by a first support member (34*a*), and a second leg pair (32*c,d*) is fixedly and rigidly interconnected by a second support member (34*b*). The first leg pair (32*a, b*) provides a left side leg pair and the second leg pair (32*c, d*) provides a right side leg pair. The two leg pairs are rigidly and fixedly interconnected by a cross member (36) which extends horizontally from midportions (37*a,b*) of the respective support members (34*a, b*). A pair of risers (38*a, b*) extend vertically upward from the base (30), and as shown a first riser (38*a*) extends upwardly from midportion (37*a*) of the first support member (34*a*), and a second riser (38*b*) extends vertically upwardly from midportion (37*b*) of a second support member (34*b*). Each riser has attached at the top thereof a respective upwardly open U-shaped receiver (40*a, b*) for releasably receiving the axle unit (12) therein.

Each riser (34*a, b*) is vertically adjustable and has a respective first lower tube segment (42*a, b*) and a second upper tube segment (44*a, b*) telescopically received therein, and have either a lock pin (46*a, b*) or a threaded wing screw received within holes (48*a, b*) of the first tube segments (42*a,b*) for locking the relative positions of the tube segments (42, 44) for establishing a desired height for the risers (38*a,b*) and stand (14).

The resistance unit (16) is preferably in the form of weight resistance, which utilizes an attachment (50) such as a friction lope for attachment to the axle unit (12) in a midregion (51) thereof, and has a cord (52) depending from the attachment (50). A weight or weights are supported by a platform (56) attached to the cord (52). The weights (54*a, b*) may be receive the cord (52)and may rest upon the platform (56). The cord preferably has a top cord segment (66) and a bottom cord segment (68) which are releasably attached to each other preferably by utilization of a hook (70) attached to the bottom of the top segment (66) which is received within a loop (72) attached to the top of the bottom segment (68).

The detachable upper body exerciser handle elements (18*a, b*) preferably have a male end (58) which is threadably received by the respective threaded orifice (26, 28), and has an arm (60) fixedly attached thereto and extending radially outward therefrom, and has a shaft (62) extending horizontally from the radially outward (distal) end of the arm (60). The handle elements (18*a, b*) further include a handle grip (64) which is rotatively received on the shaft (62). As shown in FIG. 5, the arm (60) may have an adjustable leverage length relative to the axle axis (axle attachment point).

As shown in FIG. 1, when the entire exercise device (full assembly) is utilized, the user may engage the respective handle elements (18*a, b*) with the user's left and right hands, then the user may cause rotation of the axle (12) about a horizontal axis (longitudinal axis of the axle) to force the cord (52) to wrap around the axle unit (12) thereby raising the platform (56) and the weights (54*a,b*) carried thereon, thereby storing potential energy in the weights (54*a,b*) (resistance unit (16)). Then after several rotations of the axle unit (12), the user may then allow the potential energy in the weights (54*a,b*) to be released by permitting counter rotation of the axle unit (12). The adjustable stand (14) allows for accommodating the various heights of users and may be moved from a height suitable for use by a 20 person seated to a position usable for a person in a position standing. The use of the releasible attachment (50) allows for conversion of the device into various subassemblies, and the detachable nature of the handle elements (18*a, b*) further permits conversion of the device into the various subassemblies.

Figure 2:
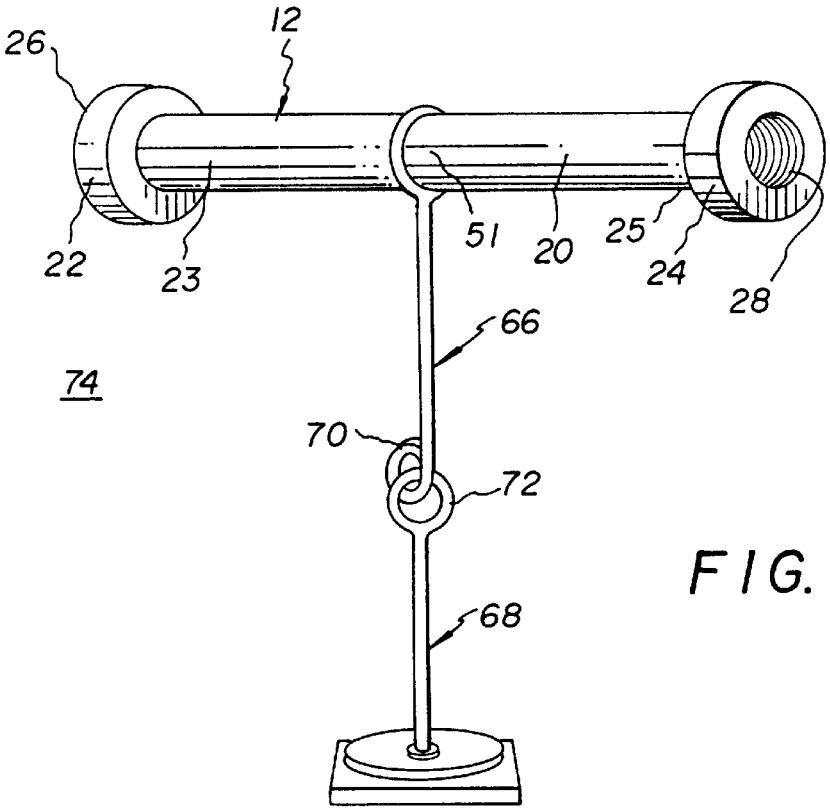
FIG. 2 is a prospective view of a wrist roller subassembly according to the present invention.

As shown in FIG. 2, a wrist roller subassembly (74) comprises the axle unit (12) having attached thereto the resistance unit (16). The axle unit has at its respective ends the first and second handle units (22, 24) for permitting strengthening of the user's wrists. In use, the wrist roller (74) is used by the user grabbing with the left hand the first handle unit (22) and with the right hand the second handle unit (24) with the palms overlapping the threaded orifices (26, 28) thereby permitting strengthening of the wrist by having the desired wrist rotation motion work against the selected force provided by the resistance unit. Using the cord segments (66, 68)as shown allows for quick adjustment of the desired amount of weight of the resistance unit (16).

Figure 3:
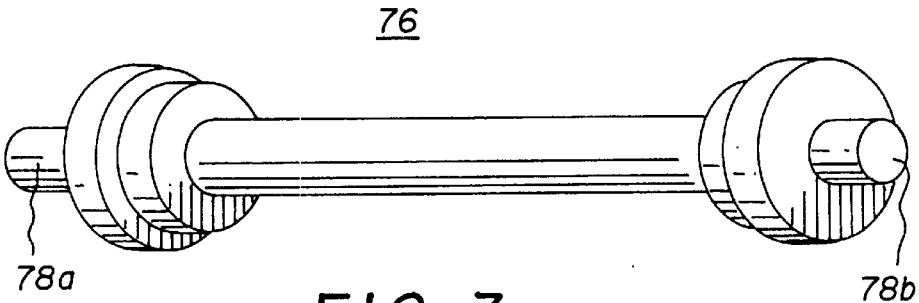
FIG. 3 is a prospective view of a dumb bell subassembly according to the present invention.

As shown on FIG. 3, a dumb bell assembly (76) may be quickly and easily formed by removing the resistance unit (16) from the axle unit (12) of the wrist roller (74), threading weight holding bar end sections (78*a, b*) into respective orifices (28, 26) and extending and positioning (counterbalancing, respective) weight (54*a*) on end section (78*a*) and second weight (54*b*) on the second end section (78*b*). This arrangement provides for a creation of a dumb bell subassembly (76) which may be used in the similar exercise routine as a conventional dumbbell.

Figure 4:
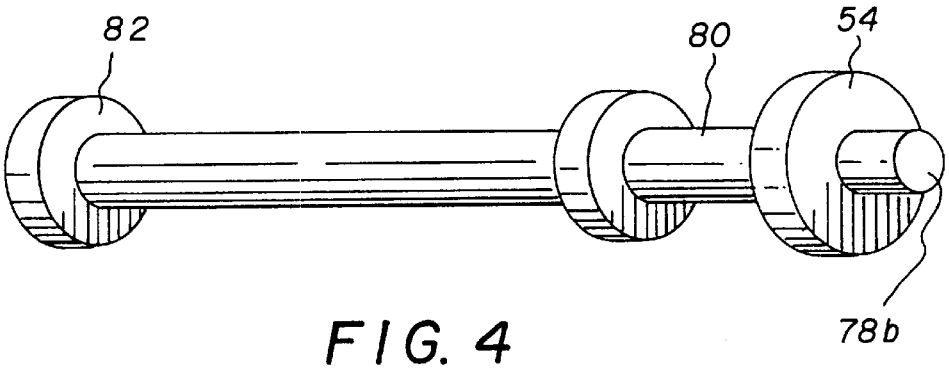
FIG. 4 is a prospective view of a hammer subassembly according to the present invention.

As best shown in FIG. 4, a hammer type exercise assembly (82) may be created by detaching the resistance unit (16) from the wrist roller (74), and threading an extension element (80) onto one end of the axle unit (12) by threading a male end of the extension unit (80) into the respective threaded orifice. The extension element (80) has an end opposite the male end, a threaded receiving hole for receiving an end section (78) threadably therein and having a weight (54) attached to the end section (78*a*) for creation of a desired hammer subassembly (82). Use of the hammer subassembly (82) involves the user grabbing the axle unit (12) at an end of the bar (20) opposite the end of the axle unit having the extension element (80) (weight (54)), using the hammer subassembly in a similar fashion as a conventional Thor's hammer exercising item.

As set forth above, the present invention allows for the quick and easy conversion of an upper body exerciser into multiple useful subassemblies including subassemblies useful for enhancing grip strength and strength of user's wrist.

What is claimed is:

1. An exercise apparatus comprising:

(a) an elongated cylindrical bar having a central portion and a first and second end;

(b) a first attachment comprising a hammer extension element and an end section for forming a Thor's hammer exerciser, and a second attachment comprising a telescopic exerciser handle for selectively varying leverage when rotating said cylindrical bar;

(c) said cylindrical bar first end having a first annular handle extending orthogonally from said cylindrical bar first end and first means defining a first orifice in said cylindrical bar first end for selectively receiving either of said first or second attachments;

d) said cylindrical bar second end having a second annular handle extending orthogonally from said cylindrical bar second end and second means defining a first orifice in said cylindrical bar first end for selectively receiving either of said first or second attachments;

e) a resistance unit detachably attached to said central portion of said cylindrical bar for biasing said cylindrical bar in a predetermined position.

2. The exercise device of claim 1 wherein said resistance unit comprises a cable and at least two weights.

3. The exercise apparatus according to claim 1, wherein said first means defining said fist orifice is threaded to threadedly receive said first attachment.

4. The exercise apparatus according to claim 1, wherein said second means defining said second orifice is threaded to threadedly receive said second attachment.

5. The exercise apparatus according to claim 1, further comprising a stand for receiving said cylindrical bar.

6. The exercise apparatus according to claim 5, wherein said stand includes a base, first and second separated, vertically adjustable risers connected to said base, and first and second u-shaped receivers connected respectively to said first and second riser for securely receiving said cylindrical bar.

7. The exercise apparatus according to claim 6, wherein said adjustable risers are telescopically adjustable to vary an effective height of said risers.

* * * * *